US007614842B2

(12) United States Patent
Ellefson et al.

(10) Patent No.: US 7,614,842 B2
(45) Date of Patent: Nov. 10, 2009

(54) LIFT ARM ASSEMBLY WITH INTEGRATED CYLINDER STOP

(75) Inventors: Shawn Ellefson, Bismarck, ND (US); Warren Schatz, Mandan, ND (US)

(73) Assignee: Clark Equipment Company, West Fargo, ND (US)

( * ) Notice: Subject to any disclaimer, the term of this patent is extended or adjusted under 35 U.S.C. 154(b) by 70 days.

(21) Appl. No.: 11/679,621

(22) Filed: Feb. 27, 2007

(65) Prior Publication Data

US 2008/0203372 A1 Aug. 28, 2008

(51) Int. Cl.
*E02F 3/80* (2006.01)

(52) U.S. Cl. ..... 414/680; 298/17 R; 298/22 R

(58) Field of Classification Search ..... 414/680, 414/686, 694; 298/17 R, 22 R; 292/169.11, 292/289, 297, 298
See application file for complete search history.

(56) References Cited

U.S. PATENT DOCUMENTS 3,120,972 A * 2/1964 Remke et al. ..... 292/169.22
3,982,648 A 9/1976 Luedtke et al.
4,039,093 A 8/1977 Schmitz, Jr. et al.
4,355,944 A 10/1982 Lorenc
4,373,851 A 2/1983 Confoey
4,947,705 A 8/1990 Yates et al.
5,009,566 A 4/1991 Asche
5,169,278 A 12/1992 Hoechst et al.
5,634,762 A 6/1997 Kim
6,149,374 A 11/2000 Dershem et al.
6,354,184 B1 3/2002 Hansen et al.
6,493,616 B1 12/2002 Rossow et al.
6,698,114 B2 3/2004 Bares et al.
6,729,830 B2 5/2004 Wagner et al.
2006/0062662 A1 * 3/2006 Curl et al. ..... 414/680

* cited by examiner

*Primary Examiner*—Donald Underwood
(74) *Attorney, Agent, or Firm*—John D. Veldhuis-Kroeze; Westman, Champlin & Kelly, P.A.

(57) ABSTRACT

A hydraulic lift arm assembly includes a lift arm, a lift cylinder raising and lowering the lift arm, a lift arm stop, and a stowing mechanism. The stowing mechanism automatically retains the lift arm stop in a stowed position in response to the lift arm stop moving into the stowed position. The lift arm stop is movable into a locked position in which the stop resists substantial actuation of the lift cylinder from an extended condition, and thereby resists substantial lowering of the lift arm from a raised position. The lift arm stop may include a slot and pin arrangement to permit linear and pivotal movement of the stop with respect to the lift arm. The linear movement may provide clearance for a tongue on the stop to pivot past a portion of the lift cylinder as the stop is moved into the locked position.

18 Claims, 9 Drawing Sheets

LIFT ARM ASSEMBLY WITH INTEGRATED CYLINDER STOP

BACKGROUND

The present invention relates to lift arm assemblies that may be used, for example, in compact construction vehicles such as all wheel steer utility vehicles. Such lift arm assemblies in some cases include cylinder stops that may be engaged to lock the lift arm in a raised position.

SUMMARY

In one embodiment, the invention provides a hydraulic lift arm assembly comprising: a lift arm movable between raised and lowered positions; a lift cylinder having a cylinder body and an extensible rod, one of the cylinder body and extensible rod being coupled to the lift arm such that extension and retraction of the extensible rod with respect to the cylinder body moves the lift arm toward the raised and lowered positions, respectively; a lift arm stop coupled to the lift arm, and movable while coupled to the lift arm between a stowed position in which the stop is detachably coupled to the lift arm and a locked position in which the stop resists substantial retraction of the extensible rod with respect to the cylinder body and thereby resists substantial lowering of the lift arm from the raised position; and a stowing mechanism automatically detachably coupling the stop to the lift arm in response to the stop being moved into the stowed position.

In another embodiment, the invention provides a hydraulic lift arm assembly comprising: a lift arm movable between raised and lowered positions; a lift cylinder having a cylinder body and an extensible rod, one of the cylinder body and extensible rod being coupled to the lift arm such that extension and retraction of the extensible rod with respect to the cylinder body moves the lift arm toward the raised and lowered positions, respectively; and a lift arm stop coupled to the lift arm, and movable while coupled to the lift arm between a stowed position in which the stop is detachably coupled to the lift arm and a locked position in which the stop resists substantial retraction of the extensible rod with respect to the cylinder body and thereby resists substantial lowering of the lift arm from the raised position. The stop is linearly and pivotably coupled to the lift arm to permit the stop to be moved linearly with respect to the lift arm to provide sufficient clearance for the stop to pivoted past a portion of the cylinder body and into the locked position.

In another embodiment, the invention provides a method for operating a lift arm stop on a lift arm that is movable between raised and lowered positions in response to a lift cylinder moving between extended and retracted conditions, respectively, the method comprising the steps of: (a) moving the lift cylinder into the extended condition to position the lift arm in the raised position; (b) when it is desired to lock the lift arm in the raised position, moving the lift arm stop, while maintaining the stop coupled to the lift arm, into engagement with the lift cylinder to resist substantial movement of the lift cylinder toward the retracted condition to thereby resist substantial lowering of the lift arm from the raised position; (c) when it is desired to lower the lift arm, moving the stop, while maintaining the stop coupled to the lift arm, out of engagement with the lift cylinder and into a stowed position in which the stop does not resist movement of the lift cylinder toward the retracted condition; and (d) automatically coupling the stop to the lift arm in response to the stop being moved into the stowed position such that the stop is resiliently retained in the stowed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
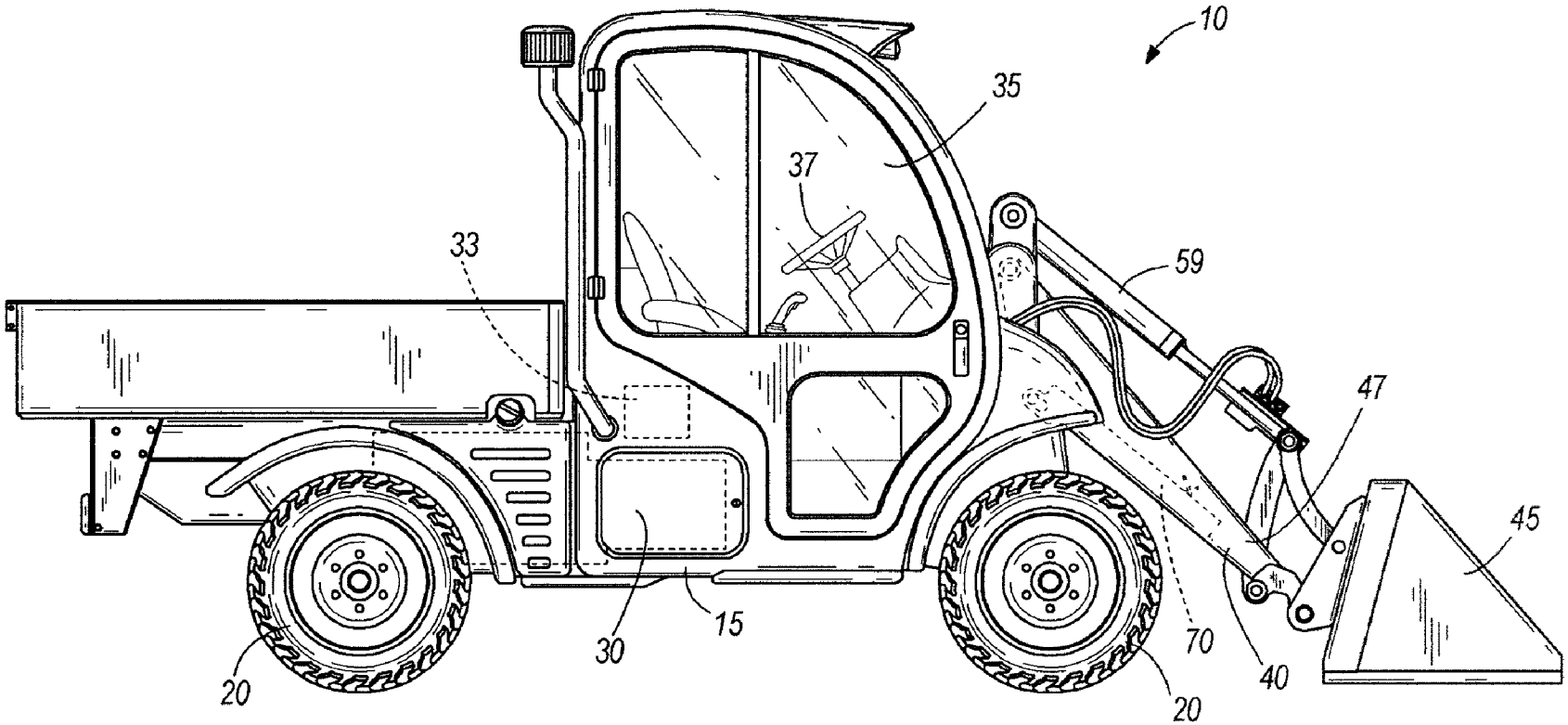
FIG. 1 is a side view of an all wheel steer utility vehicle including a lift arm assembly embodying the present invention.
Figure 2:
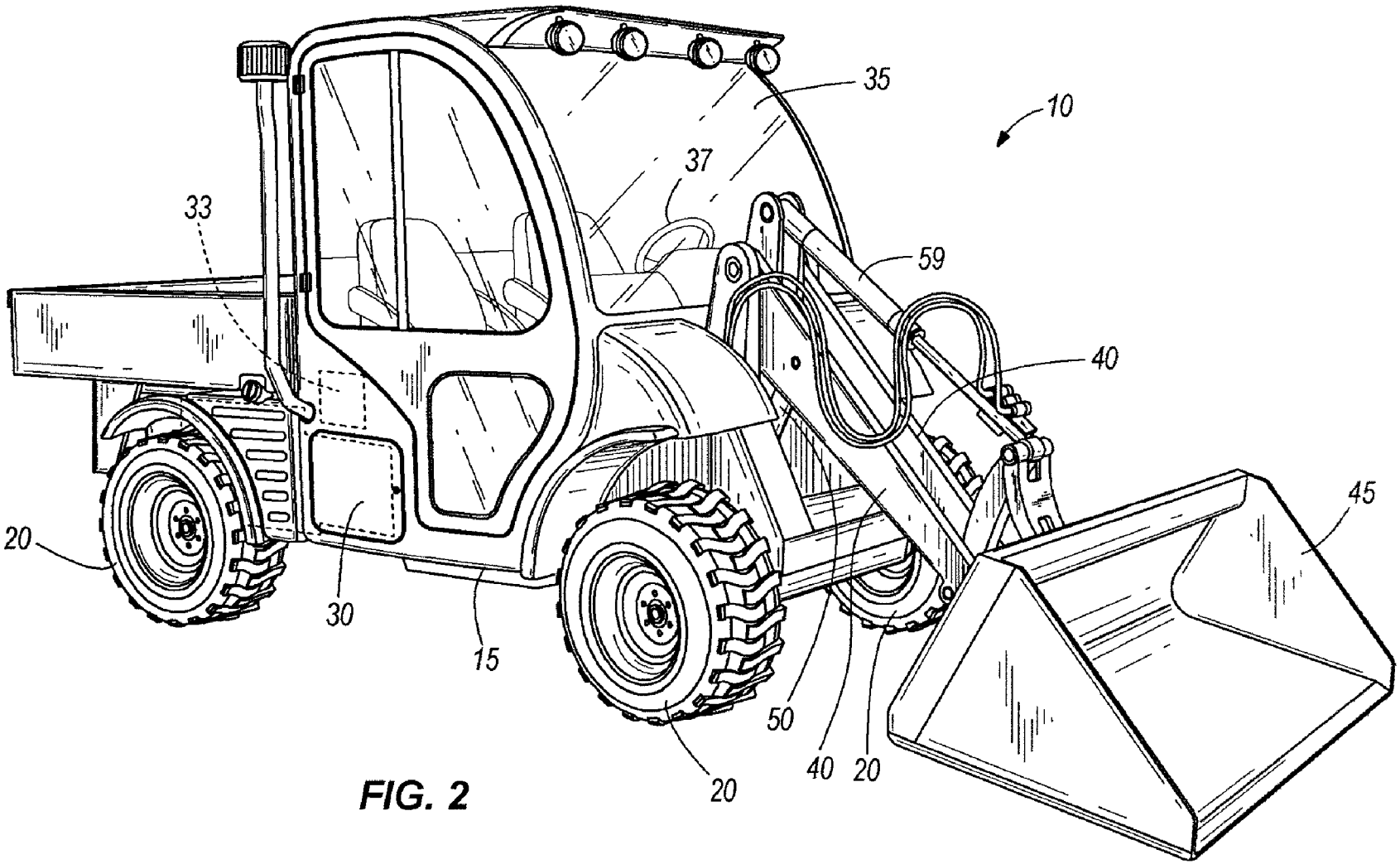
FIG. 2 is a perspective view of the all wheel steer utility vehicle.
Figure 3:
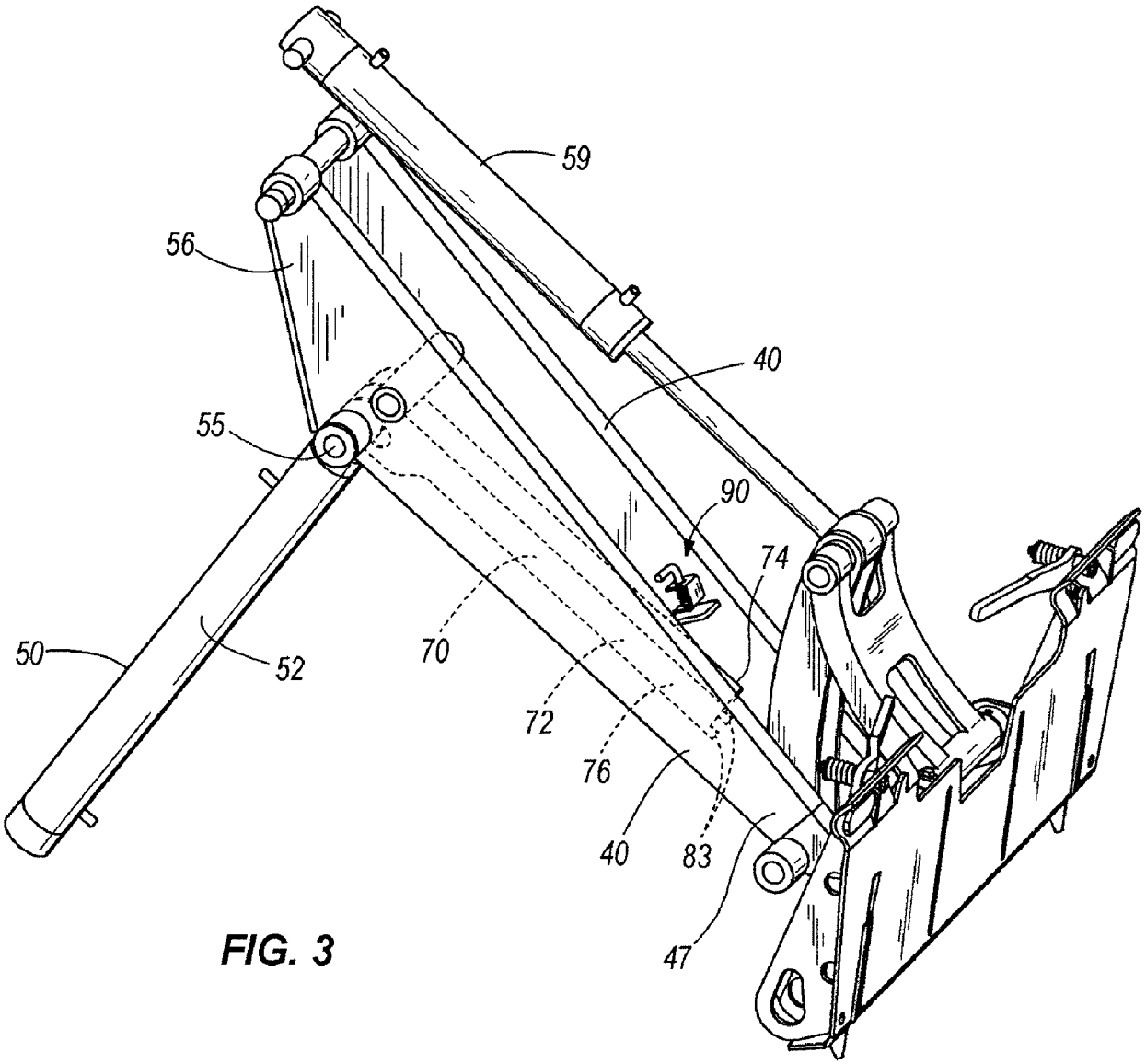
FIG. 3 is a perspective view of the lift arm assembly.

FIGS. 1 and 2 depict an all wheel steer utility vehicle 10 having a frame 15 supported by four wheels 20, an internal combustion engine 30 driving operation of a hydraulic system 33, an operator compartment 35 that contains an operator control 37 (which is a steering wheel in the illustrated embodiment), a pair of lift arms 40, and a bucket 45 mounted for tilting at a distal end 47 of each lift arm 40. The all wheel steer utility vehicle 10 may in some models drive rotation of two (i.e., front or rear) of the wheels 20 and in other models drive rotation of all four of the wheels 20 through the hydraulic system 33. As the name implies, all four wheels react to manipulation of the operator control 37, and tight maneuvering is enabled by steering with all four wheels in an all wheel steer utility vehicle. Although the invention is illustrated embodied in an all wheel steer utility vehicle 10, the invention may be embodied in other vehicles and machines, such as for example an all wheel steer loader or another type of compact construction vehicle. Although the illustrated operator control 37 takes the form of a steering wheel, in other embodiments, the control may include joysticks and/or foot pedals. Although the illustrated prime mover for the vehicle is the internal combustion engine 30, other prime movers and sources of energy including but not limited to fuel cells, solar energy, batteries, and corded electric motors may be used in other embodiments.

The lift arms 40 raise (i.e., rotate counterclockwise in FIG. 1) and lower (i.e., rotate clockwise in FIG. 1) with respect to the frame 15 under the influence of a lift cylinder 50 mounted between the frame 15 and the lift arms 40. The lift cylinder 50 operates under the influence of the hydraulic system 33, and includes a cylinder body 52 and an extensible rod 54 (see FIGS. 4A-4C). Extension and retraction of the rod 54 with respect to the cylinder body 52 causes respective raising and lowering of the lift arms 40. In the illustrated embodiment, the lift arms 40 are pivotably coupled to the rod 54 at a pin 55 such that extension of the rod 54 relative to the cylinder body 52 causes a proximal end 56 of the lift arms 40 to pivot, thereby raising the distal end 47 of the lift arms 40.

The bucket 45 tilts with respect to the lift arms 40 to curl (i.e., rotate counterclockwise in FIG. 1) and dump (i.e., rotate clockwise in FIG. 1) under the influence of a tilt cylinder 59 mounted between the lift arms 40 and the bucket 45. The tilt cylinder 59 operates under the influence of the hydraulic system 33. Various auxiliary implements or devices may be substituted for or used in conjunction with the bucket 45. An example, but by no means exhaustive, list of auxiliary implements includes augers, jack hammers, trenchers, grapples, rotary sweepers, stump grinders, saws, concrete mixers, pumps, chippers, snow throwers, rotary cutters, and backhoes.

A lift arm stop 70 is provided between the lift arms 40 and is movable between a stowed position and locked or installed position. In the locked position, the stop 70 resists retraction of the rod 54 with respect to the cylinder body 52 to thereby resist lowering of the lift arms 40 from the raised position (i.e., the rod 54 is locked in an extended position relative to the cylinder body 52). In the stowed position, the stop 70 is substantially entirely between the lift arms 40 and is detachably coupled to one of the lift arms 40. The lift arm stop 70 includes a channel shaped body 72 having a base portion 74 and outwardly extending sidewalls 76 defining an approximately U-shaped channel 78 therein (see FIG. 5C). The body 72 has a first end 80 that is pivotably coupled to the lift arms 40 and a second, free, or engaging end 82 that is detachably coupled to the lift arms 40. The second end 82 of the body 72 can be detached from the lift arms 40 to permit the body 72 to pivot at the first end 80 relative to the lift arms 40. Extending longitudinally (i.e, generally parallel to the longitudinal axis of the body 72) from the sidewalls 76 of the second end 82 of the body 72 are a pair of retaining tongues 83. The tongues add to the overall length of the stop 70.

The first end 80 of the body 72 can have an elongated slot 84 that is pivotably mounted to a pin 86 on the lift arms 40. The body 72 can pivot about the pin 86 and also slide axially or linearly (i.e., generally in the direction of the longitudinal extent of the slot 84, which in the illustrated embodiment is generally parallel to the longitudinal axis of the body 72) relative to the pin 86, and in this regard the stop 70 is pivotably and linearly coupled to the lift arms 40. The pin 86 is said to be "bottomed out" in the slot 84 when the pin 86 is at the end of the slot 84 illustrated in FIG. 4F when the stop 70 in the installed or locked position. The pin 86 is said to be "topped out" in the slot 84 when the pin 86 is at the opposite end of the slot (as illustrated in FIG. 4A) when the stop 70 is in a stowed position.

In the illustrated embodiment, the pin 86 also pivotably couples the rod 54 to the lift arms 40 (i.e., pin 86 and the pin 55 are co-axial or are the same element). Therefore, the body 72 and rod 54 are pivotable with respect to the lift arms 40 about the same axis. In other embodiments, however, the pin 86 can be separate from the pin 55 so that the body 72 and rod 54 are pivotably attached to the lift arms 40 about non-collinear pivot axes. In such other embodiments, the pin 86 may be provided on the first end 80 of the body 72 and the slot may be provided in one or both of the lift arms 40.

When the lift arm 40 is fully raised (i.e., the rod 54 is extended its full stroke out of the cylinder body 52), the lift arm stop 70 can be installed so as to lock the lift arm 40 in the raised position. By "installing" it is meant only that the lift arm stop 70 is moved from a first or stowed configuration or position as shown in FIG. 4A to a second, installed, or locked configuration or position as shown in FIG. 4F. The lift arm stop 70 remains permanently secured to the lift arm 40 and/or is an integral part of the lift arm 40 throughout the installation process.

Figure 4B:
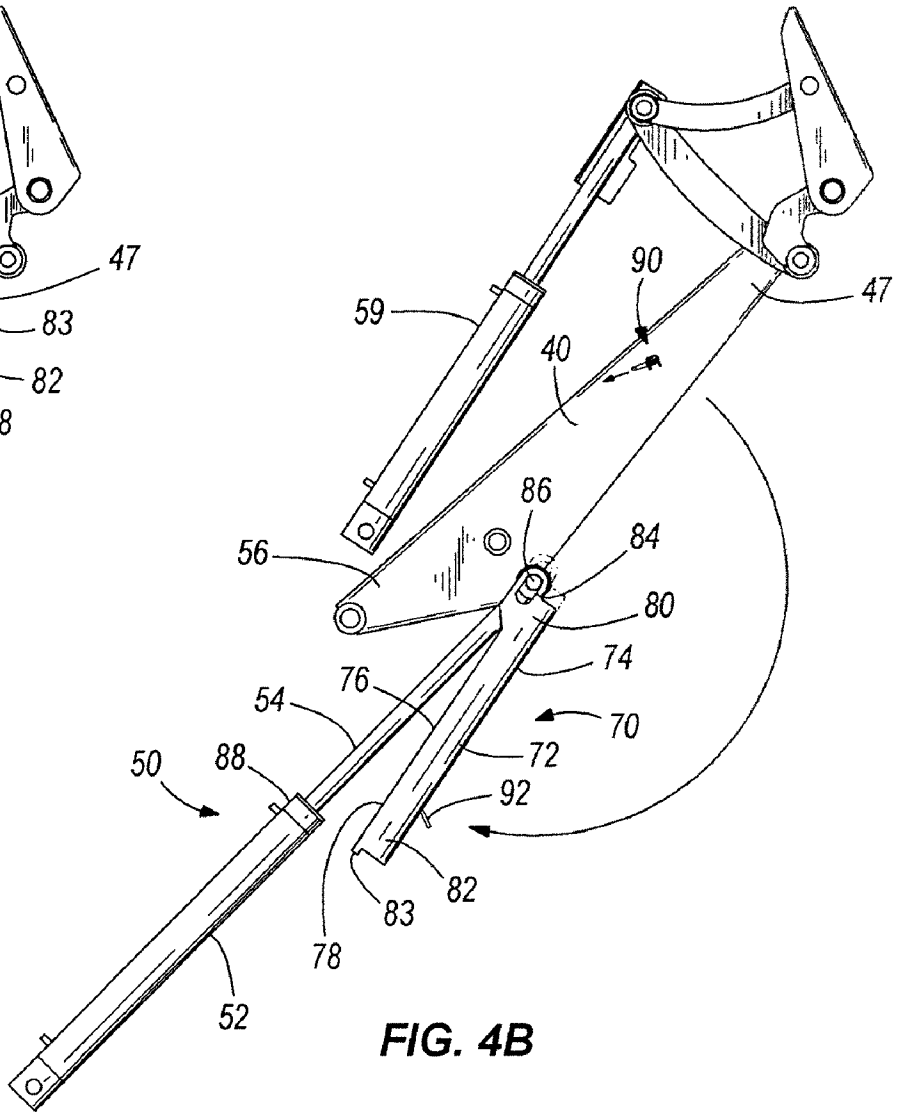
FIGS. 4A-4F are side views of the lift arm assembly with a lift arm stop being moved between an installed position and a stowed position.
Figure 4A:
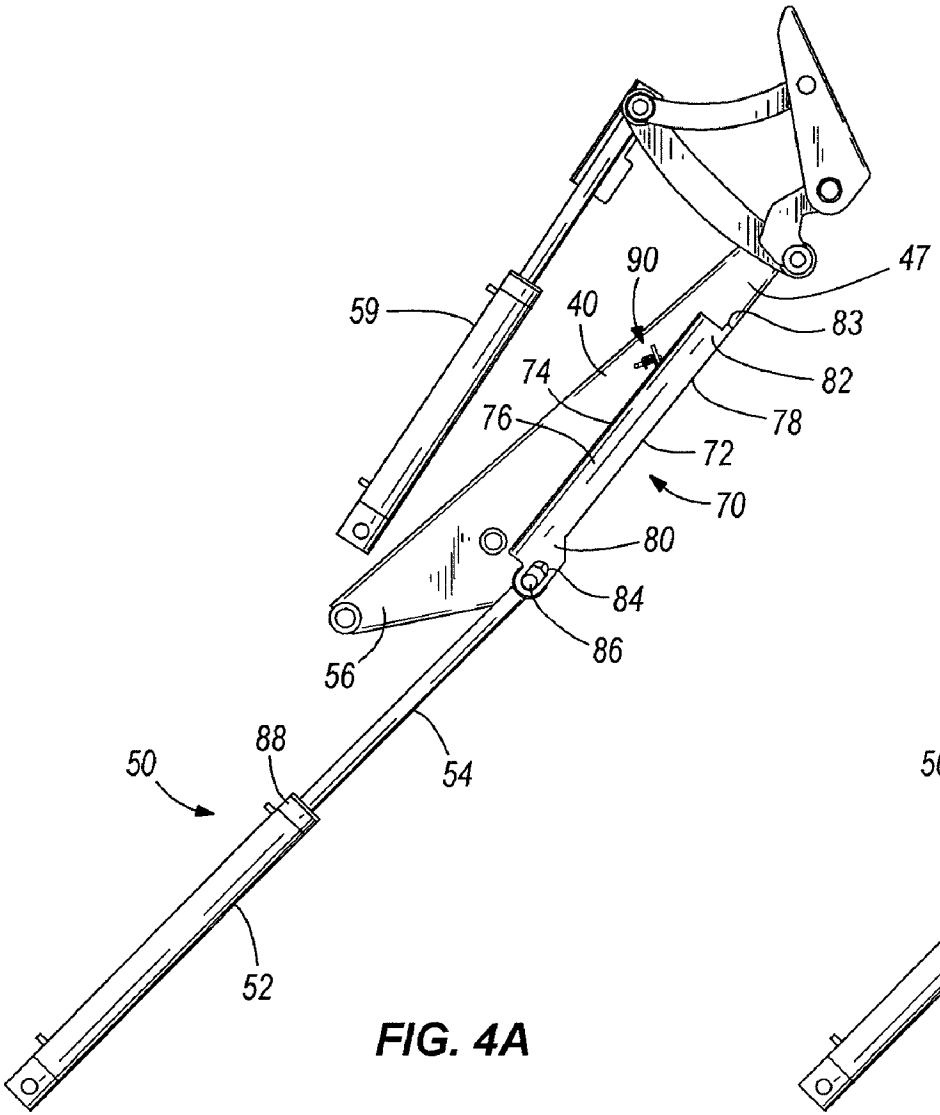
Figure 4D:
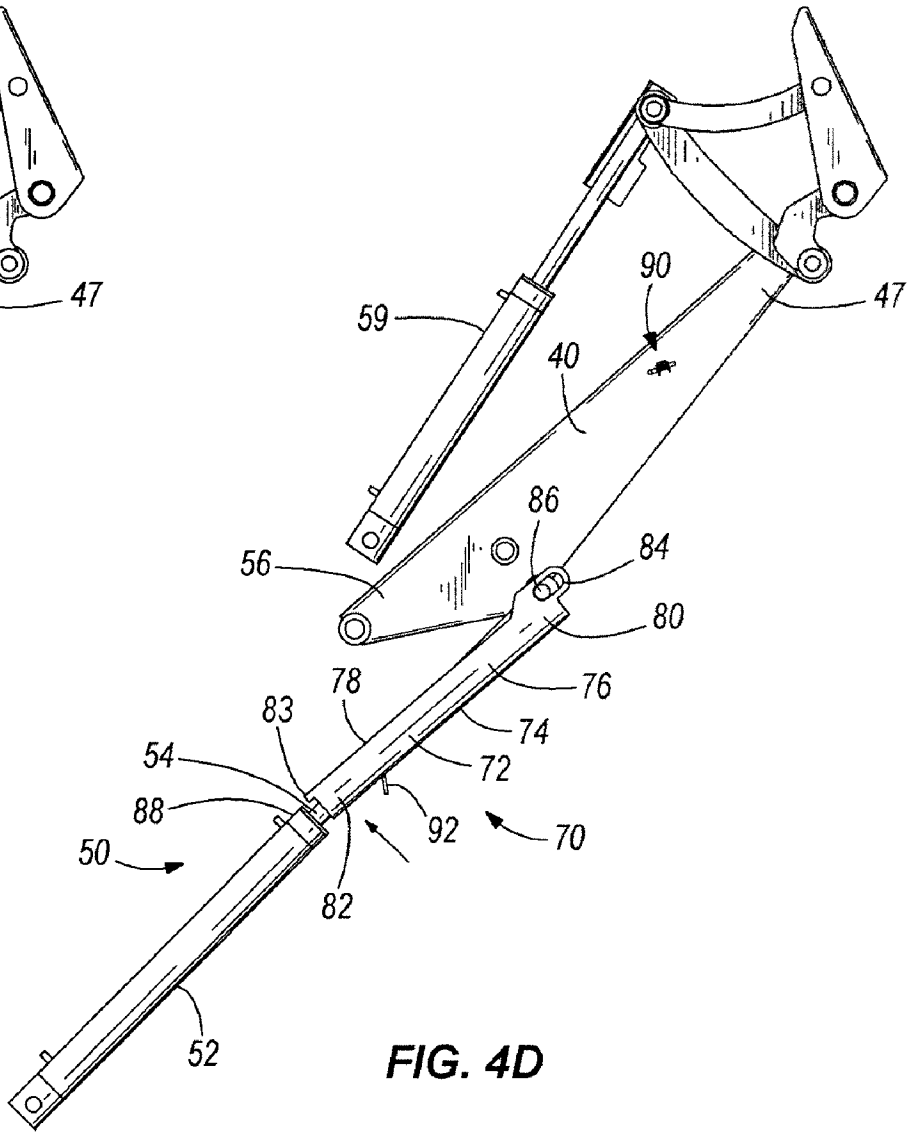
Figure 4C:
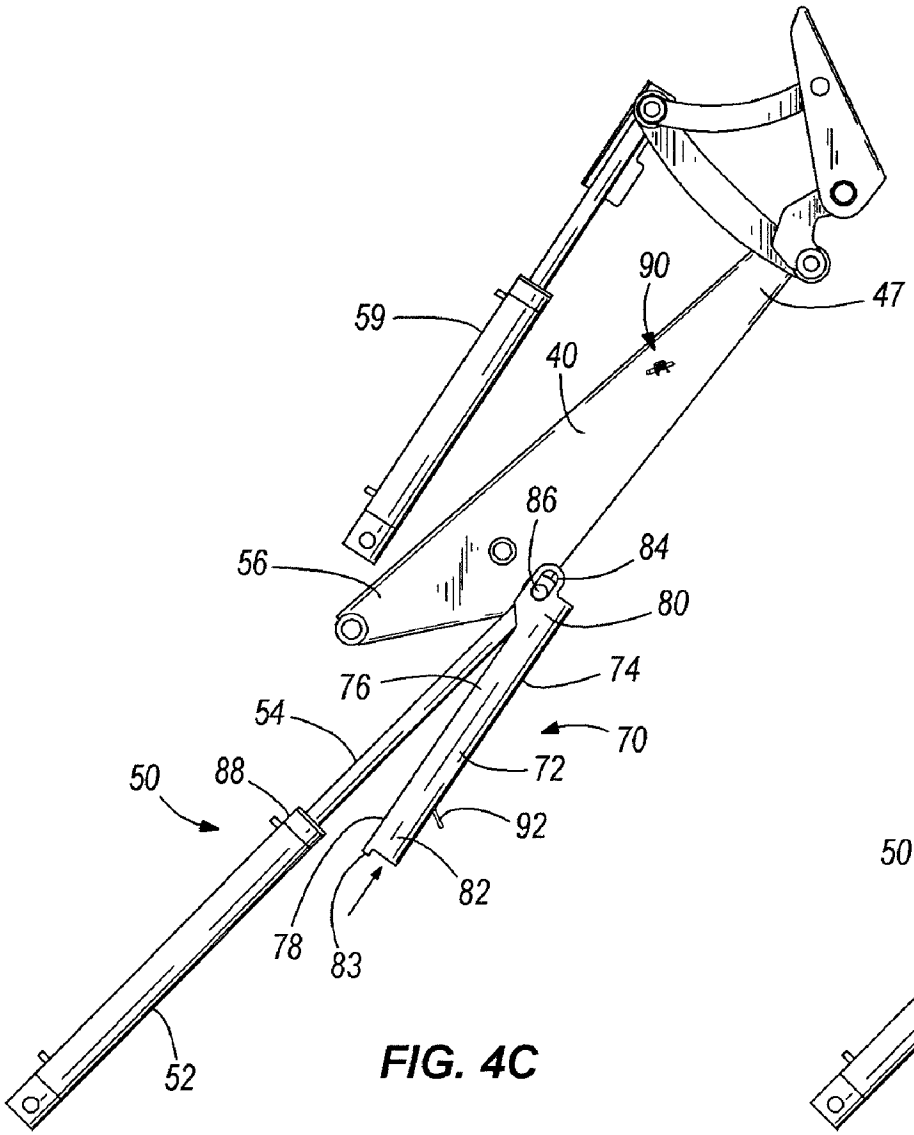
Figure 4F:
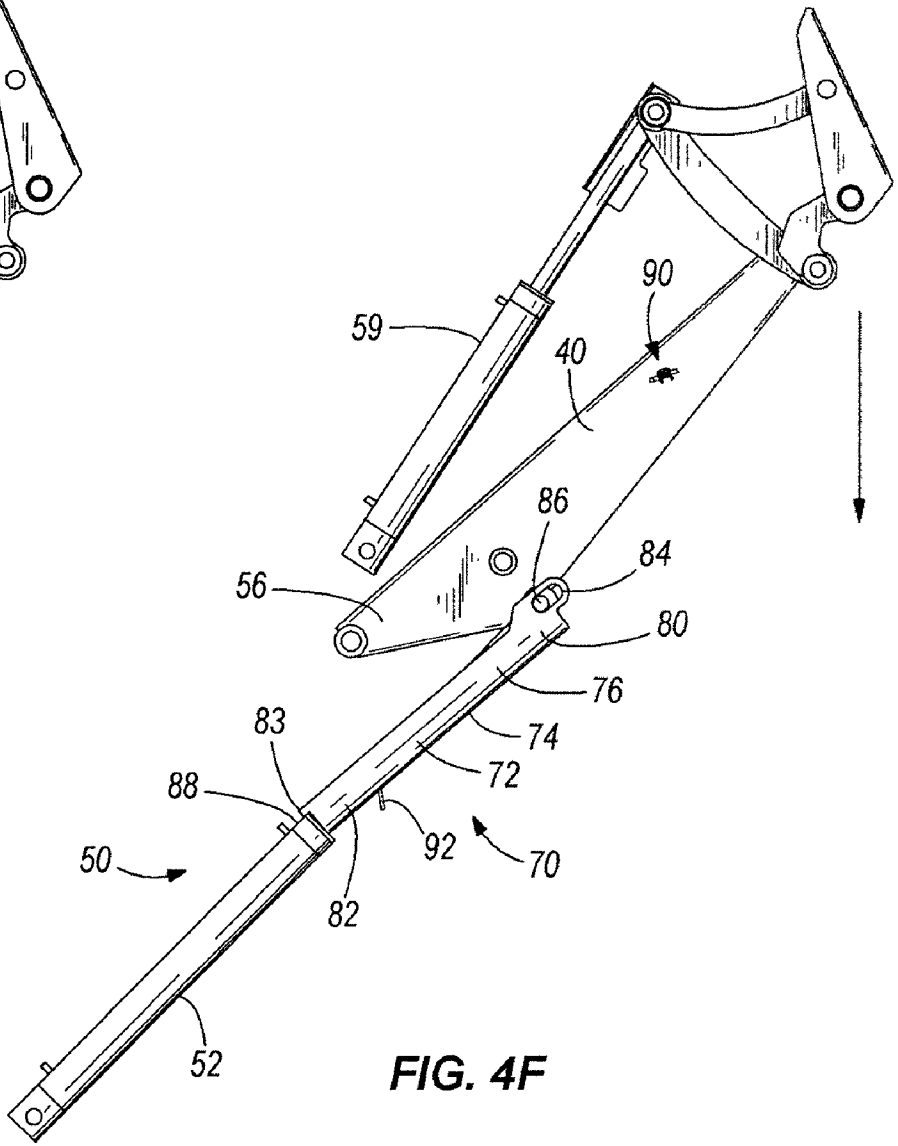

To initiate installation, the second end 82 of the body 72 is detached from the lift arm 40 and the body 72 is pivoted about the pin 86 (see FIG. 4B). The body 72 can be slid axially or linearly in a first direction away from the cylinder body 52 via the slot 84, until the pin 86 bottoms out in the slot 84 (see FIG. 4C). This creates a gap between the second end 82 of the body 72 and the end of the cylinder body 52. The body 72 can be pivoted further about the pin 86 so that the tongues 83 pivot through the gap and past the end of the cylinder body 52 (see FIG. 4D). Once pivoted into this position, the channel 78 receives the rod 54 and the rod 54 is enclosed on three sides by the base portion 74 and sidewalls 76.

Figure 4E:
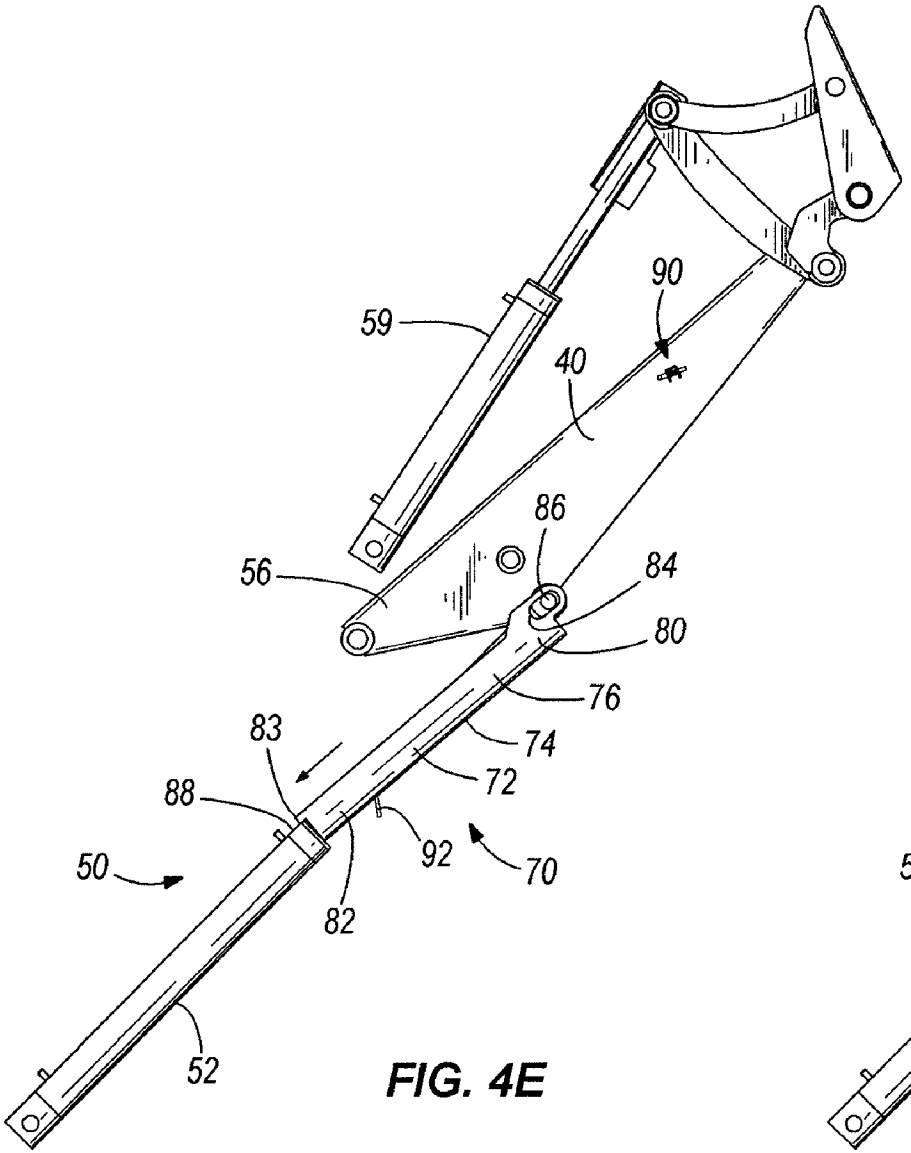

The body 72 is then slid down in a second direction (opposite the first direction) until the second, engaging end 82 rests against the end of the cylinder body 52 (see FIG. 4E). The slot 84 is sufficiently long such that the pin 86 will not top out in the slot 84 prior to the second end 82 of the body 72 engaging the cylinder body 52, even when the rod 54 is fully extended. In this position, the tongues 83 engage a back side 88 of the cylinder body 52 and prevent the body 72 from inadvertently pivoting away from the cylinder body 52. The lift arm 40 can then be lowered slightly (i.e., the rod 54 can be slightly retracted relative to the cylinder body 52) until the pin 86 bottoms out in the slot 84 (see FIG. 4F). This causes the body 72 to become clamped in the installed or locked position between the cylinder body 52 and the pin 86 and lift arms 40. In this respect, the lift arms 40 are not completely raised when the stop 70 is in the locked position (i.e., the lift arms are lowered from the fully-raised position less than the length of the slot 84), but the stop 70 does resist substantial retraction of the rod 54 and substantial lowering of the arms 40.

In the illustrated embodiment, the installed body 72 shares a longitudinal axis with the rod 54 or has a longitudinal axis that is close to that of the rod 54. The body 72 therefore provides structural support to the raised lift arm 40 along approximately the same axis as the lift cylinder 50 does in supporting the lift arm 40. In other embodiments, however, the installed body 72 can extend at a larger angle relative to the rod 54. This can occur when the pin 86 and the pin 55 are non-coaxial.

In the illustrated embodiment, the length of the stop 70 from the end of the tongues 83 to the bottom of the slot 84 is slightly shorter than the combined length of the portion of the rod 54 extending out of the cylinder body 52 when the lift arms 40 are fully raised and any rod end or other connecting structure that connects the rod 54 to the pin 86. In other embodiments, however, in which the pin 86 is not co-axial with the pin 55, the length of the body 72 may be sized appropriately so that the second end 82 of the body 72 is adjacent the end of the cylinder body 52 when the lift arms 40 are fully raised (i.e., when the rod 54 is fully extended). Furthermore, in those embodiments in which the pin 86 is not co-axial with the pin 55, none or only a portion of the rod 54 may be received in the channel 78.

When it is desired to unlock the lift arm 40, the installation steps are reversed. That is, the lift arms 40 are raised slightly to move the pin 86 up in the slot 84. Then, the body 72 is slid axially via the slot 84 away from the cylinder body 52 until the pin 86 bottoms out in the slot 84 or there is sufficient clearance for the tongues 83 to pivot past the end of the cylinder body 52 through the gap. The tongues 83 are disengaged from the cylinder body 52 and the body 72 is pivoted about the pin 86 away from the cylinder body 52. The second end 82 of the body 72 can then be reattached to the lift arm 40 for stowing.

Figure 5B:
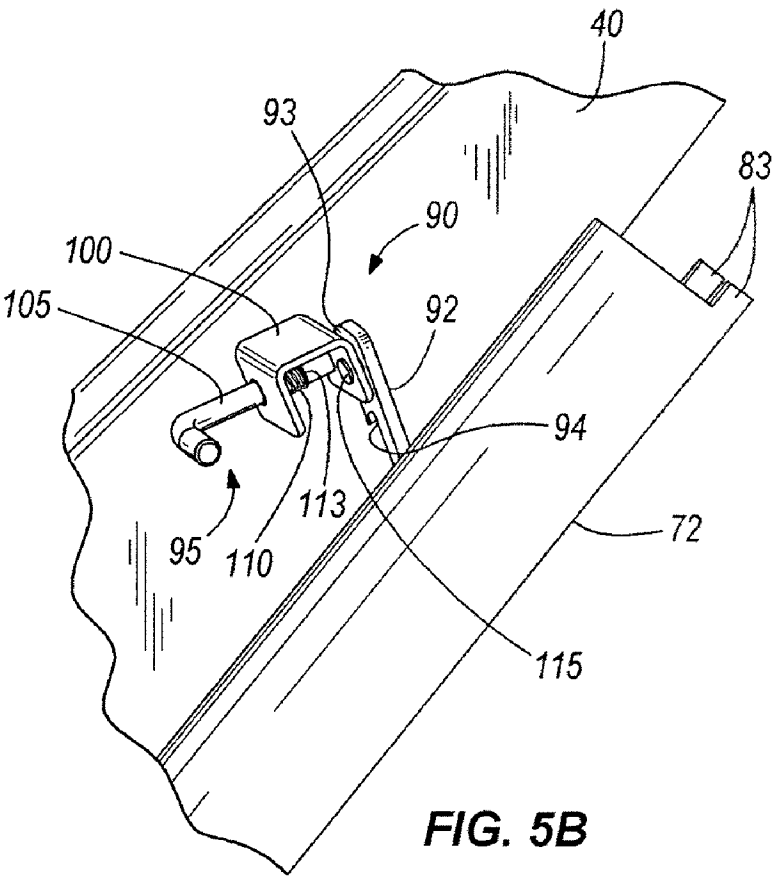
FIGS. 5A-5E are views of a portion of a stowing mechanism for the lift arm stop.
Figure 5A:
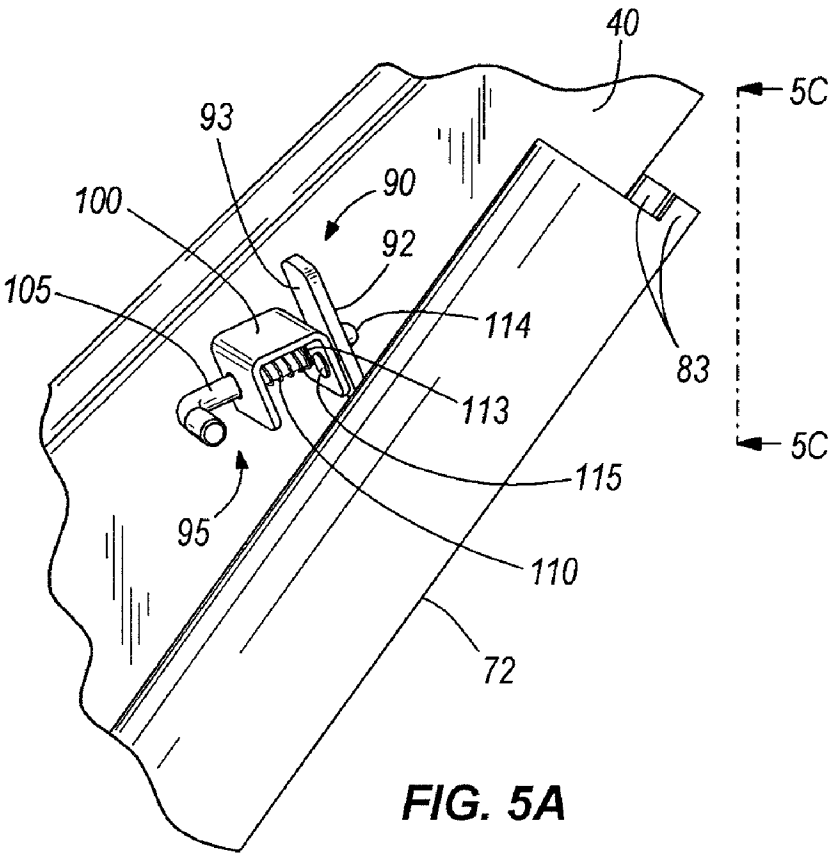
Figure 5C:
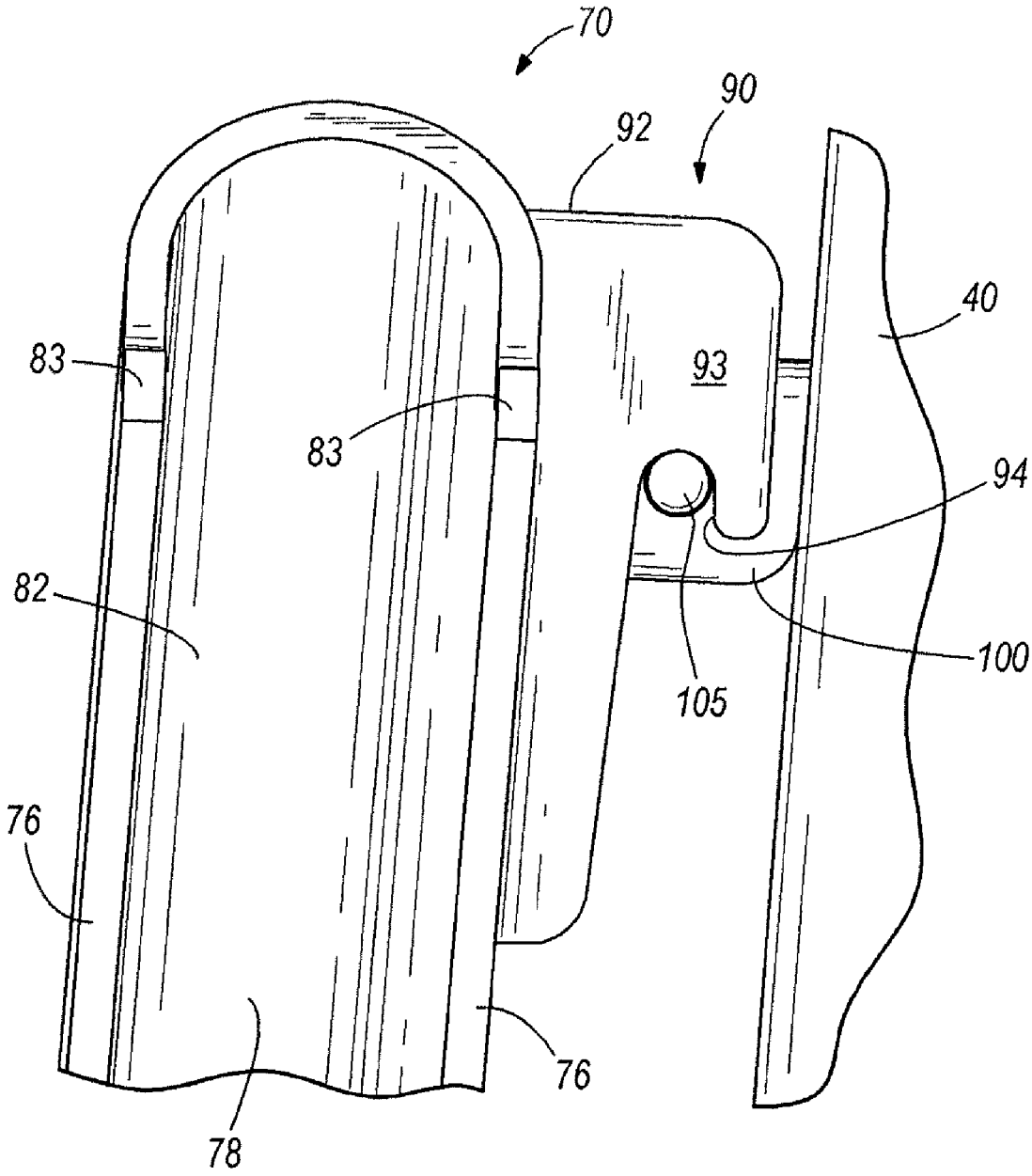

FIGS. 5A-5C depict the second end 82 of the body 72 including a stowing mechanism 90 that is at least partially positioned between the lift arms 40. The stowing mechanism 90 is used for securing the lift arm stop 70 in the stowed position when not in use. The stowing mechanism 90 includes a capturing member 92 and a resilient member or mechanism 95. In the illustrated embodiment, the capturing member 92 is on the second end 82 of the body 72 and the resilient mechanism 95 is on one of the lift arms 40. In other embodiments, however, the capturing member 92 can be on the lift arm 40 while the resilient member or mechanism 95 is on the body 72. The capturing member 92 is positioned on the body 72 so as to be adjacent to the resilient mechanism 95 when the body 72 is pivoted into the stowed position with the pin 86 topped out in the slot 84. In the illustrated embodiment, the longitudinal axis of the body 72 is generally parallel to a longitudinal axis of the lift arm 40 when in the stowed position.

The capturing member 92 includes an abutment portion 93 and a receiving portion, which in the illustrated embodiment is a hook 94 that defines a downwardly-opening slot. In other embodiments, the receiving portion of the capturing member 92 may include, for example, a slot, groove, dimple, recess or aperture in place of the hook 94. In other embodiments, the receiving portion can be integrated into the body 72 (e.g., a hook, slot, groove, dimple, recess, or aperture formed in the base portion 74 or sidewalls 76).

Figure 5D:
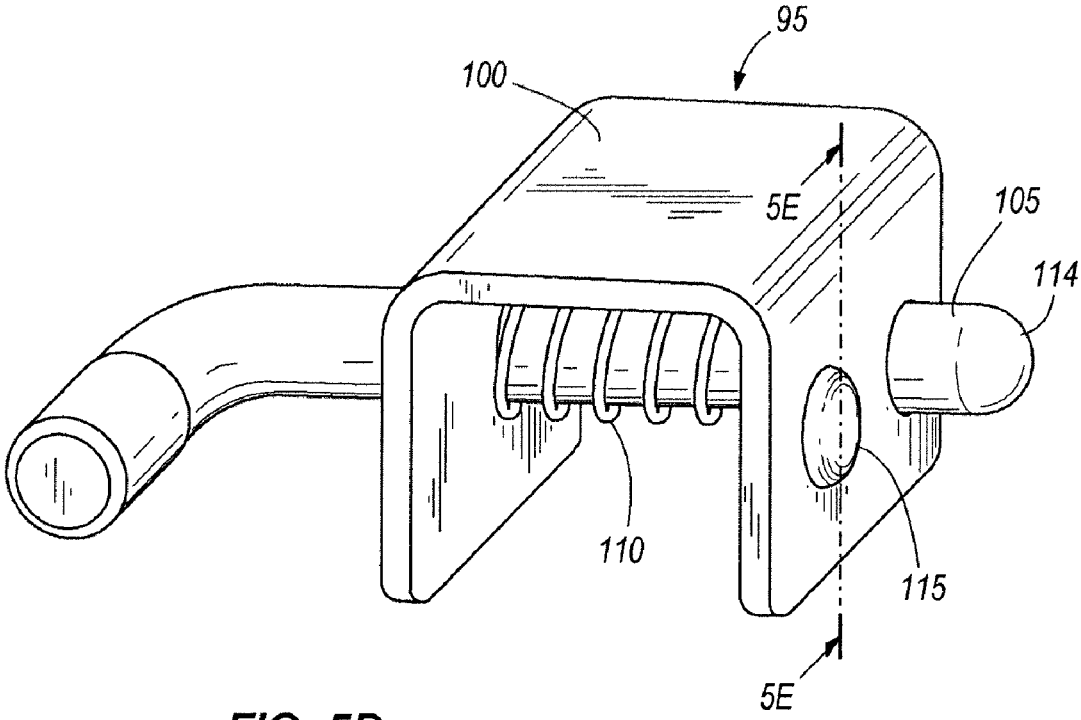
Figure 5E:
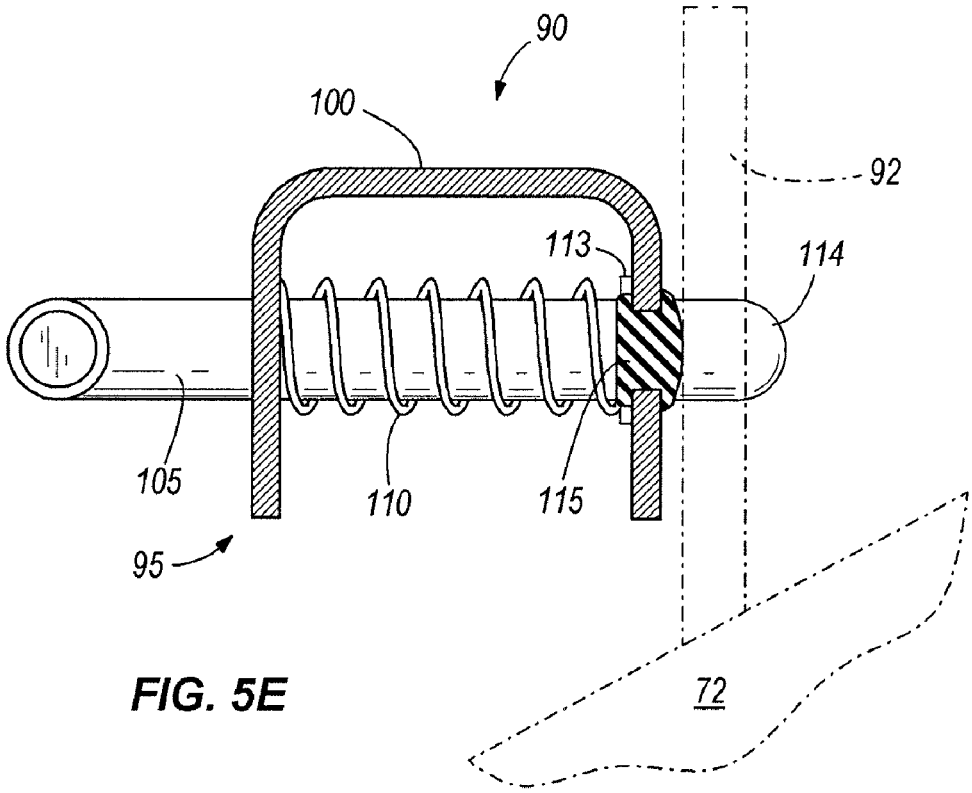

With reference to FIGS. 5D and 5E, the resilient mechanism 95 includes a U-shaped bracket 100, a pin 105 extending through holes in the two legs of the bracket 100, and a spring 110 surrounding the pin 105 and biasing it into an extended position (i.e., in which the pin 105 extends out the right side of the bracket 100 in FIG. 5E). A snap ring 113 (seen in FIG. 5B) is affixed to the pin 105 and therefore moves with the pin 105. The snap ring 113 abuts against one end of the spring 110 and deflects the spring 110 against the left leg of the bracket 100 (as in FIG. 5B) when the pin 105 is pulled. The pin 105 includes a rounded end 114. In other embodiments, the spring-biased or spring-loaded pin 105 may be replaced by another suitable deflectable portion. The resilient mechanism 95 also includes a dampening member 115 secured in a hole in the right leg of the bracket 100 (as viewed in FIG. 5E) next to the pin 105. The dampening member 115 is constructed of a resilient material such as rubber.

When the pin 86 is topped out in the slot 84 (i.e., the distance between the pin 86 and the second end 82 is maximized as in FIG. 4A), the body 72 may be pivoted up between the lift arms 40 and the capturing member 92 will barely clear the right side (as viewed in FIG. 5E) of the bracket 100. As the capturing member moves across the right side of the bracket 100, the abutment portion 93 abuts against and deflects, deforms, or compresses the pin 105 and spring 110 assembly. The rounded end 114 of the pin 105 facilitates a smooth, relatively low friction, sliding engagement between the pin 105 and abutment portion 93, as the abutment portion 93 comes into contact with and deflects the pin 105. At about the same time, the abutment portion 93 abuts against and resiliently deflects the dampening member 115.

When the portion of the abutment portion 93 above the slot defined by the hook 94 moves slightly beyond or clears the end 114 of the pin 105 so that the open slot of the hook 94 is aligned with the end 114 of the pin 105, the spring 110 snaps from its deflected condition (FIG. 5B) into its at-rest condition (FIG. 5A) or is otherwise released and automatically captured by or received in the slot defined by the hook 94 of the capturing member 92. In the at-rest condition, the snap ring 113 is against the right leg of the bracket 100, and the spring 110 is preloaded. The rounded end 114 of the pin 105 facilitates sliding into the open slot defined by the hook 94, even when there is slight misalignment between the end 114 of the pin 105 and the slot of the hook 94. The lift arm stop 70 is thereby automatically secured to the lift arm 40 when moved into the stowed position by merely moving the lift arm stop 70 into the stowed position. In the stowed position, the dampening member 115 is sandwiched between the portion of the abutment portion 93 alongside slot defined by the hook 94 and the right leg of the bracket 100. The dampening member 115 dampens and reduces vibrations being transmitted between the body 72 and the lift arms 40 through the stowing mechanism 90. The primary vibrations dampened by the dampening member 115 are those directed generally parallel to long axis of the slot 84. Such dampening may reduce rattling, chatter, and other noise that may be generated by the body 72 when in the stowed position.

To release the lift arm stop 70 from the lift arm 40 for installation, the resilient mechanism 95 can be manually deformed to release the resilient mechanism 95 from the capturing member 92, as shown in FIG. 5B. In the illustrated embodiment, an operator merely hooks or grasps the pin 105 with a finger, tool, or device and pulls to move the snap ring 113 to the left (as illustrated). This movement deflects the spring 110 and moves the end 114 of the pin 105 clear of the slot defined by the hook 94.

Thus, the invention provides, among other things, a system and method for locking a lift arm in a raised position. Various features and advantages of the invention are set forth in the following claims.

What is claimed is:

1. A hydraulic lift arm assembly comprising:

a lift arm movable between raised and lowered positions;

a lift cylinder having a cylinder body and an extensible rod, one of the cylinder body and extensible rod being coupled to the lift arm such that extension and retraction of the extensible rod with respect to the cylinder body moves the lift arm toward the raised and lowered positions, respectively;

a lift arm stop coupled to the lift arm, and movable while coupled to the lift arm between a stowed position in which the stop is detachably coupled to the lift arm and a locked position in which the stop resists substantial retraction of the extensible rod with respect to the cylinder body and thereby resists substantial lowering of the lift arm from the raised position, one of the stop and lift arm including a slot, and the other of the stop and lift arm including a pin within the slot to linearly and pivotably couple the stop to the lift arm and to permit pivotal and linear movement of the stop with respect to the lift arm, the stop including at least one tongue extending from an engaging end of the stop, the stop and lift arm being so disposed and arranged such that linear movement of the stop in a first direction with respect to the lift arm moves the pin linearly within the slot and thereby creates a gap between the engaging end of the stop and a portion of the cylinder body, the gap providing sufficient clearance for the at least one tongue to pivot past the portion of the cylinder body as the stop moves toward the locked position, the stop and lift arm being so disposed and arranged such that linear movement of the stop in a second direction opposite the first direction moves the pin linearly within the slot in the opposite direction and thereby positions the stop in the locked position in which the engaging end of the stop engages the portion of the cylinder body and the at least one tongue engages a back side of the cylinder body, engagement of the at least one tongue against the back side of the cylinder body resists pivotal movement of the stop out of the locked position; and a stowing mechanism automatically detachably coupling the stop to the lift arm in response to the stop being moved into the stowed position.

2. The hydraulic lift arm assembly of claim 1, wherein the stowing mechanism includes a capturing member on one of the stop and the lift arm and a resilient mechanism on the other of the stop and the lift arm; and wherein the resilient mechanism resiliently engages the capturing member upon movement of the stop into the stowed position.

3. The hydraulic lift assembly of claim 2, wherein the resilient mechanism includes a deflectable portion; wherein the capturing member includes an abutment surface deflecting the deflectable portion as the stop is moved toward the stowed position; and wherein the capturing member further includes a receiving portion into which the deflectable portion extends upon moving the abutment surface past the deflectable portion.

4. The hydraulic lift arm assembly of claim 3, wherein the deflectable portion includes a spring biased pin.

5. The hydraulic lift arm assembly of claim 1, wherein the stowing mechanism includes a vibration dampening member for dampening the transmission of vibrations between the lift arm and the stop through the stowing mechanism.

6. The hydraulic lift assembly of claim 1, wherein the lift arm includes a pair of lift arms; wherein at least a portion of the stowing mechanism is positioned between the pair of lift arms; and wherein the stop is substantially entirely positioned between the pair of lift arms when in the stowed position.

7. The hydraulic lift arm assembly of claim 1, wherein the stop and lift cylinder are pivotably coupled to the lift arm at substantially coaxial pivoting axes.

8. A hydraulic lift arm assembly comprising:

a lift arm movable between raised and lowered positions;

a lift cylinder having a cylinder body and an extensible rod, one of the cylinder body and extensible rod being coupled to the lift arm such that extension and retraction of the extensible rod with respect to the cylinder body moves the lift arm toward the raised and lowered positions, respectively; and a lift arm stop coupled to the lift arm, and movable while coupled to the lift arm between a stowed position in which the stop is detachably coupled to the lift arm and a locked position in which the stop resists substantial retraction of the extensible rod with respect to the cylinder body and thereby resists substantial lowering of the lift arm from the raised position;

wherein one of the stop and lift arm includes a slot, and the other of the stop and the lift arm includes a pin within the slot to linearly and pivotably couple the stop to the lift arm to permit the stop to be moved linearly with respect to the lift arm as the pin moves linearly within the slot to provide sufficient clearance for the stop to pivot about the pin past a portion of the cylinder body and into the locked position.

9. The hydraulic lift arm assembly of claim 8, wherein the stop includes at least one tongue extending from an engaging end of the stop; wherein linear movement of the stop in a first direction with respect to the lift arm creates a gap between the engaging end of the stop and the portion of the cylinder body; wherein the gap provides sufficient clearance for the at least one tongue to pivot past the portion of the cylinder body as the stop moves toward the locked position; wherein linear movement of the stop in a second direction opposite the first direction positions the stop in the locked position in which the engaging end of the stop engages the portion of the cylinder body and the at least one tongue engages a back side of the cylinder body; and wherein engagement of the at least one tongue against the back side of the cylinder body resists pivotal movement of the stop out of the locked position.

10. The hydraulic lift arm assembly of claim 8, further comprising a stowing mechanism automatically detachably coupling the stop to the lift arm in response to the stop being moved into the stowed position.

11. The hydraulic lift arm assembly of claim 10, wherein the stowing mechanism includes a capturing member on one of the stop and the lift arm and a resilient mechanism on the other of the stop and the lift arm; and wherein the resilient mechanism resiliently engages the capturing member upon movement of the stop into the stowed position.

12. The hydraulic lift arm assembly of claim 10, wherein the stowing mechanism includes a vibration dampening member for dampening the transmission of vibrations between the lift arm and the stop through the stowing mechanism.

13. The hydraulic lift arm assembly of claim 8, wherein the stop and lift cylinder are pivotably coupled to the lift arm at substantially coaxial pivoting axes.

14. A method for operating a lift arm stop on a lift arm that is movable between raised and lowered positions in response to a lift cylinder moving between extended and retracted conditions, respectively, the method comprising the steps of:

(a) moving the lift cylinder into the extended condition to position the lift arm in the raised position;

(b) when it is desired to lock the lift arm in the raised position, moving the lift arm stop pivotably and linearly with respect to the lift arm, while maintaining the stop coupled to the lift arm, to move the lift arm stop into engagement with the lift cylinder to resist substantial movement of the lift cylinder toward the retracted condition to thereby resist substantial lowering of the lift arm from the raised position, further comprising linearly moving the stop with respect to the lift arm to create a gap between the stop and a portion of the lift cylinder, pivoting the stop into alignment with the portion of the lift cylinder, and linearly moving the stop into engagement with the portion of the lift cylinder;

(c) when it is desired to lower the lift arm, moving the stop, while maintaining the stop coupled to the lift arm, out of engagement with the lift cylinder and into a stowed position in which the stop does not resist movement of the lift cylinder toward the retracted condition; and (d) automatically coupling the stop to the lift arm in response to the stop being moved into the stowed position such that the stop is resiliently retained in the stowed position.

15. The method of claim 14, wherein the stop includes at least one tongue; wherein pivoting the stop into alignment includes pivoting the at least one tongue through the gap past the portion of the lift cylinder and aligning an engagement portion of the stop with the portion of the lift cylinder; and wherein moving the stop into engagement includes engaging the portion of the lift cylinder with the engagement portion of the stop and positioning the at least one tongue adjacent a back side of the cylinder to resist pivotal movement of the stop out of engagement with the cylinder.

16. The method of claim 14, wherein the lift arm includes a pair of lift arms; and wherein step (d) includes positioning the stop substantially entirely between the pair of lift arms.

17. The method of claim 14, wherein one of the stop and lift arm includes a capturing member and the other includes a resilient mechanism; wherein step (d) includes automatically deflecting a deflectable portion of the resilient mechanism by bringing the deflectable portion into abutment with a portion of the capturing member as the stop is moved toward the stowed position, and automatically engaging the capturing member with the deflectable portion once the stop is in the stowed position.

18. The method of claim 14, further comprising dampening the transmission of vibrations between the stop and lift arm while the stop is in the stowed position.

* * * * *